US006116381A

United States Patent [19]

Jalbert

[11] Patent Number: 6,116,381

[45] Date of Patent: Sep. 12, 2000

[54] PASSIVE HALL FIXTURES MOUNTED IN ELEVATOR DOORS

[75] Inventor: Vincent P. Jalbert, Niantic, Conn.

[73] Assignee: Otis Elevator Company, Farmington, Conn.

[21] Appl. No.: 09/274,123

[22] Filed: Mar. 23, 1999

[51] Int. Cl.[7] ..... B66B 3/00

[52] U.S. Cl. ..... 187/395; 187/391; 187/397

[58] Field of Search ..... 187/391, 395, 187/380, 397

[56] References Cited

U.S. PATENT DOCUMENTS

| | | | |
|---|---|---|---|
| 0,840,659 | 1/1907 | Reilly | 187/391 |
| 1,949,245 | 2/1934 | Dugan | 187/391 |
| 2,267,271 | 12/1941 | Edwards | 187/391 |
| 5,587,567 | 12/1996 | Winter et al. | 187/395 |
| 5,679,934 | 10/1997 | Juntunen et al. | 187/395 |
| 5,821,479 | 10/1998 | Kondo et al. | 187/395 |

*Primary Examiner*—Jonathan Salata

[57] ABSTRACT

Hall call apparatus for a low-cost, low rise simplex elevator, all disposed on the hoistway doors, include a slider 25 which is released by depression of a hall call button 21 so that it is pulled upwardly by a spring 49 until it engages a stop 50. A clapper 33 overtravels when the slider stops and contacts a bell 34 to provide an audible indication that a call is registered. Holes 23, 24 in the hoistway doors form a chevron-like pattern through which colored chevron-like stripes 28 on the slider will show, to provide a visual, directional indication of the registration of the call. A passive transmitter disposed on the slider passes through flux of a permanent magnet 30 to cause a unique RF signal transmission from an antenna 31 that is picked up by an antenna 71 on the elevator car to indicate the floor and direction of the requested hall call, which may simply be applied to the car operating panel to force a car call in order to answer the request for service at a given floor. The slider is rest downwardly by a stationary reset arm when the doors are fully opened, and held in a downward position by a latch 43 until subsequently being released by pushing the hall call button 21. Instead of RF signals, each bell 34 may have a different tone sensed by a microphone to distinguish the different floors and directions of hall calls requested. Flags 36, 37 may be sensed, when the slider is in the call registering position, by sensors 60, 61 disposed on the elevator car as a backup method of determining the presence of hall calls.

15 Claims, 6 Drawing Sheets

FIG.3
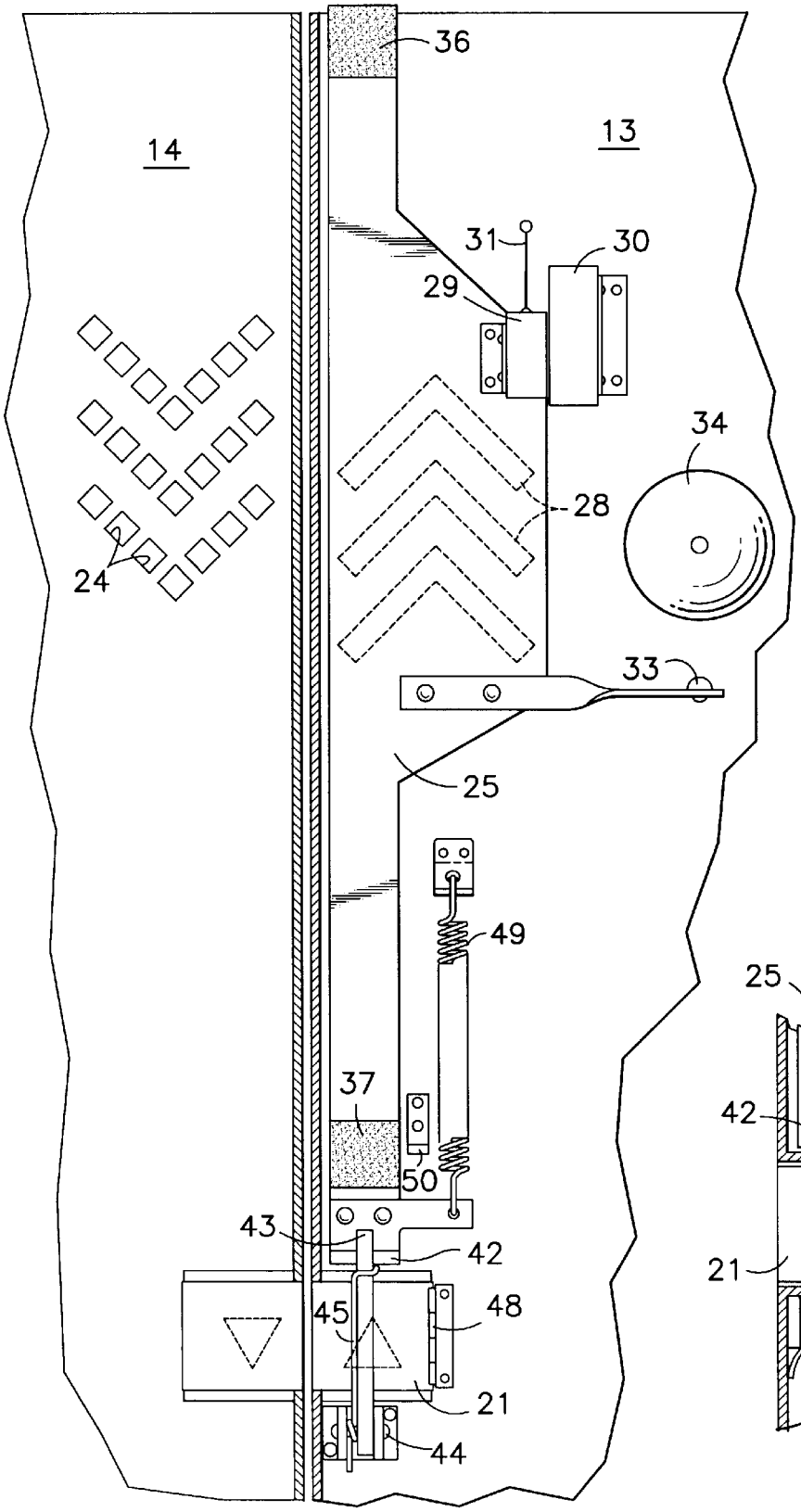
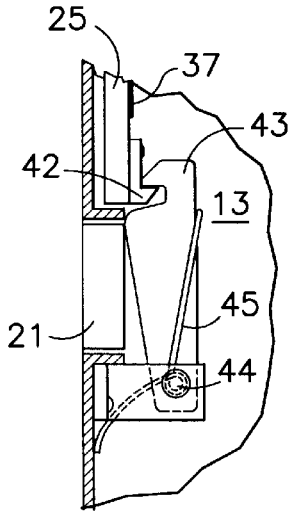
FIG.4

FIG.5
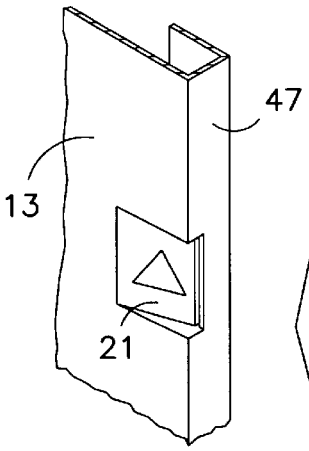
FIG.7
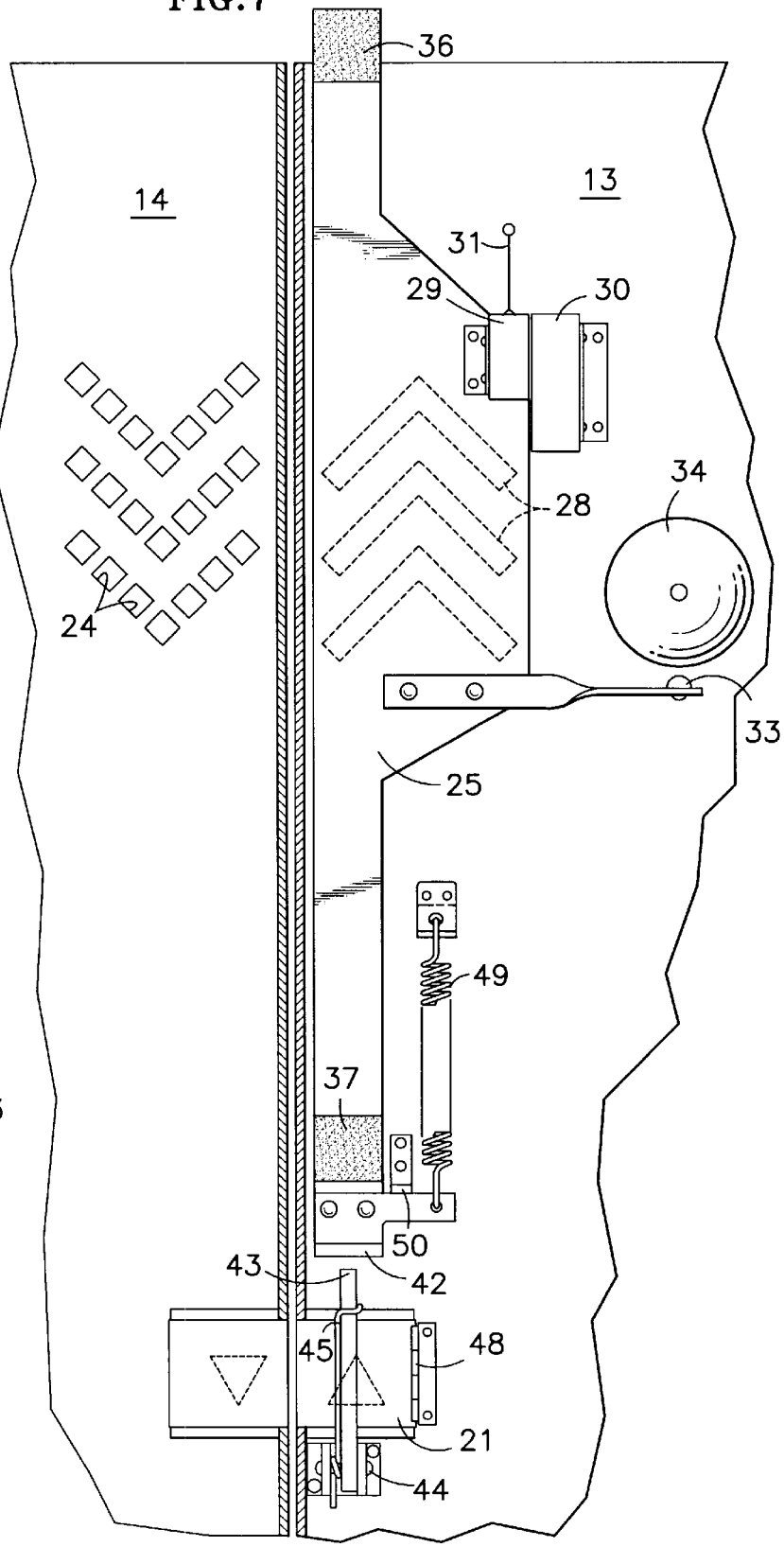
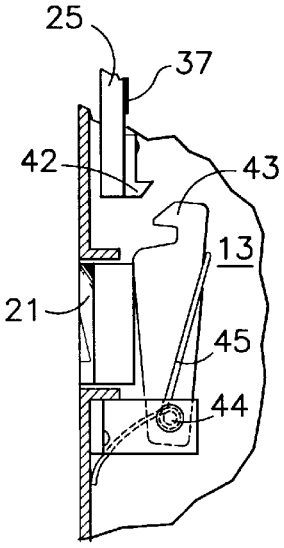
FIG.6

PASSIVE HALL FIXTURES MOUNTED IN ELEVATOR DOORS

TECHNICAL FIELD

This invention relates to provision of elevator hallway fixtures which do not require electrical power, and being located in the elevator doors, do not require specific, on-site installation.

BACKGROUND ART

Hallway fixtures in elevator systems typically include an up hall call button, a down hall call button, lights in the call buttons to indicate when a call has been registered, a gong to indicate that an elevator is approaching, and up and down lanterns to indicate the direction of the elevator. While the components themselves may not be duly expensive, installation into the building, on each floor, including electrical wiring for power and signals, is labor intensive, and therefore quite expensive. In certain elevator applications, such as public or other low cost housing, a low installed cost for an elevator system may be one of the most significant parameters determining which elevator will be selected for the application. This is particularly true of low cost, low rise simplex systems (a single elevator serving only a few floors). Another cost factor is the need to repair damage due to vandalism, particularly damage to bulbs, lenses and delicate call buttons.

DISCLOSURE OF INVENTION

Objects of the invention include provision of a low rise, simplex elevator system having a low installed cost, and improved tolerance of vandalism.

According to the present invention, the hall fixtures for a simplex elevator system are all disposed within the hoistway doors at each landing. In further accord with the invention, the necessary functions normally performed by wired elevator hall fixtures are performed by passive devices, requiring no electrical power or signal wires at the landings.

In one embodiment, a vertically slidable member disposed on the inside edge of a hoistway door is reset into a downward position when the door is opened, and latched in that position against the force of an upward-pulling spring. A hall call button is hinged within the hoistway door, and pressing the hall call button releases the vertically sliding member so that it slides upwardly, providing one or more passenger-perceptible indications that the hall call is registered, and providing one or more indications to the car controller that service is requested on that particular floor. The indications that the call is registered include a gong having a striker attached to the vertical member, and arrow-like holes in the hoistway door which appear a different color (such as green for up and red for down) as a result of the member sliding upward. The indication to the car controller that service is requested at the corresponding floor may include a radio frequency signal sent by the passive transmitter powered by a magnet, relative motion between the transmitter and the magnet as the member slides upwardly providing the energy for the transmission; the passive transmitter on each floor having a frequency different from each other floor for identification purposes. Alternatively, the bell that provides an indication to the passenger of the call being registered may have a different pitch on each floor, and the sound thereof can be monitored by a microphone to provide indications of service requests to the car controller. Another indication of a service request include flags (sensible indicia of some sort) disposed on the sliding member, and capable of being sensed from the elevator car side of the hoistway doors only when the member has been released to slide upwardly in response to pushing of a hall call button.

The invention provides the necessary apparatus to enter a service request, acknowledge that request, and forward the request to the car controller, all mounted on hoistway doors. The apparatus has substantial tolerance to vandalism. The components may all be mounted, tested and adjusted on the hoistway doors at the factory, requiring no installation effort at the building site. No power wires or signal wires are required. No invasion of the building surfaces is required, other than installation of the hoistway doors and frames. The movements and relationships of the various parts are not delicate or critical, and therefore adjustment and repair will both be minimal.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3 is a partial, partially sectioned rear elevation view of the left hoistway door of FIG. 1, prior to a hall call being registered.

FIG. 4 is a partial, partially sectioned side elevation view of a slider latch shown in FIG. 3.

FIG. 5 is a perspective view of a hall call button of FIG. 1 shown in the pressed, service-requesting position.

FIG. 6 is a partial, partially sectioned side elevation view of the latch of FIG. 4, when released by the hall call button of FIG. 5.

FIG. 7 is a partial, partially sectioned, rear elevation view of the left hoistway door of FIG. 1, showing apparatus of the invention after a hall call has been registered.

BEST MODE FOR CARRING OUT THE INVENTION

Figure 1:
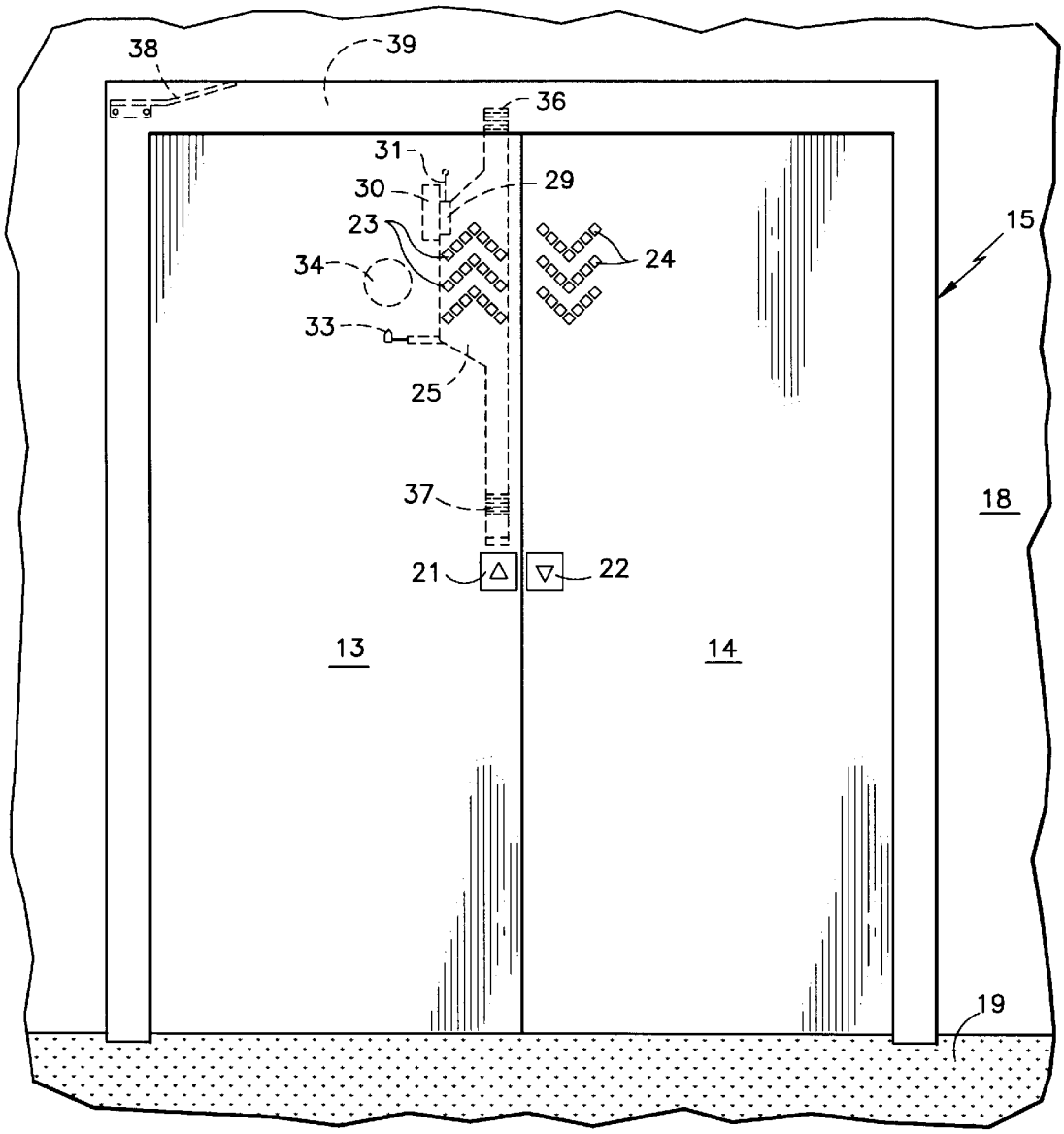
FIG. 1 is a front elevation view of elevator hoistway doors employing the present invention, prior to a hall call being registered.
Figure 2:
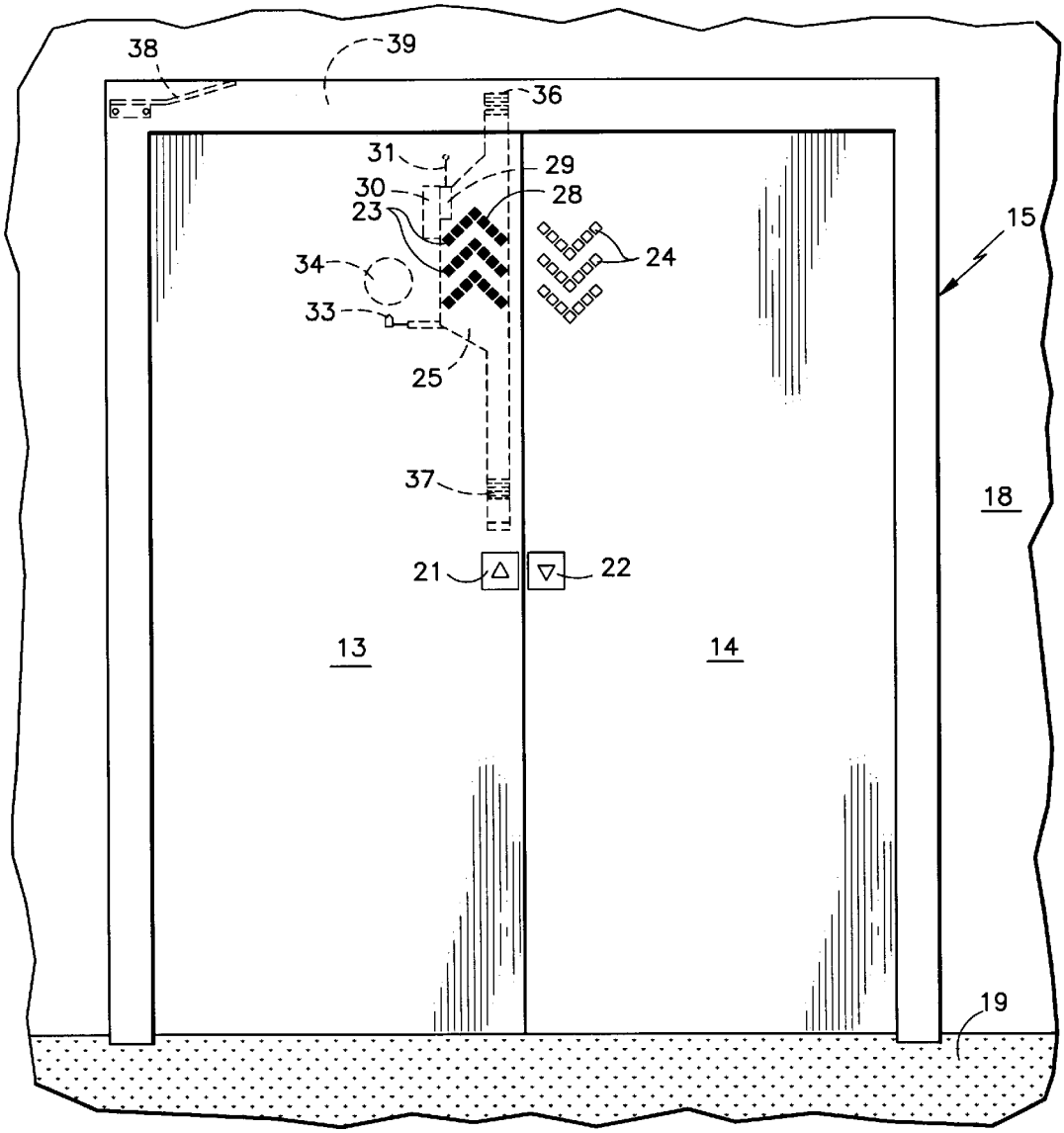
FIG. 2 is a front elevation view of elevator hoistway doors employing the present invention, after a hall call is registered.

Referring to FIG. 1, the hoistway doors 13, 14 of an elevator are set within a frame 15 which transcends the wall 18 between an elevator corridor 19 and the hoistway. In accordance with the invention, apparatus necessary to initiate a call for service, acknowledge the call and communicate the call to the car controller are all disposed within the doors 13, 14. Specifically, each door has a hall call button 21, 22, a chevron-like pattern of holes 23, 24 through the door to simulate up and down arrows, and other associated apparatus, shown for the button 21, but not for the button 22. Associated with the call button 21 is a moveable member, such as a slider 25 which is mounted to slide vertically on the inside of the hoistway door as described more fully hereinafter. After the doors have once opened to reset the device, before another call is registered, the slider 25 will be in a lower position as shown in FIG. 1. Referring to FIG. 2, when the call button 21 is pressed, it releases the slider 25 so it quickly slides to an upper position in which chevron-like stripes 28 appear behind the up-arrow designating holes 23 so as to indicate that an up call has been placed. As the slider 25 rises, a coil in a passive transmitter 29 intercepts flux from a permanent magnet 30 to energize a tank circuit that feeds an antenna 31 so as to provide a wireless, electromagnetic signal indicating that an up call has been made at the given floor. When the slider 25 hits a stop, inertia causes a bell clapper 33 to strike a bell 34, thus providing an audible indication to the passenger that the call has been registered. In addition, an upper flag 36 and a lower flag 37, described more fully hereinafter, become visible from the car side of the slider 25 to provide another indication that an up call is registered at this floor. When the doors open to respond to the call, a stationary reset arm 38, mounted to the rear fascia 39 of the hoistway door frame 15, will push the slider 25 downward to the position shown in FIG. 1 where it is latched by a mechanism (hereinafter) associated with the up call button 21.

In FIGS. 3 and 4, the apparatus described thus far is shown in detail from the rear of the hoistway doors 13, 14. The slider 25 has a lip 42 that is engaged by a latch 43 which is normally urged into the latched position shown in FIG. 4 about a pivot 44 by means of a spring 45.

Referring to FIG. 5 and FIG. 7, to avoid any pinch points for passengers should they be pressing the call button while the door is opening, the call buttons are disposed at the edge 47 of the door 13, with a hinge 48 at the edge of the button 21 which is opposite to the door edge 47. When the button is in the position shown in FIG. 5, it will rotate the latch 43 away from the lip 42 as shown in FIG. 6 so that the slider 25 will quickly slide upwardly in response to the force of a tension spring 49 until it reaches a stop 50 as seen in FIG. 7. The abrupt stop will cause the clapper 33 to strike the bell 34 providing the audible indication to the user that the call has been registered. As soon as the passenger releases the call button 21, the spring 45 will force the latch 43 back to the position of the latch shown in FIG. 4, so that when the slider is forced downwardly as the doors are opened (hereinafter) the lip 42 will push the latch 43 out of the way and then become engaged with it as seen in FIG. 4. As the slider 25 rapidly slides upwardly, a passive tank circuit within the transmitter 29 (described hereinafter) cuts through flux of the permanent magnet 30 causing a radio frequency signal to be transmitted from the antenna 31. And the chevron-like stripes 28 will now be positioned behind the holes 23 in the door 13 to provide a visual indication to the passenger that the up call has been registered.

Figure 8:
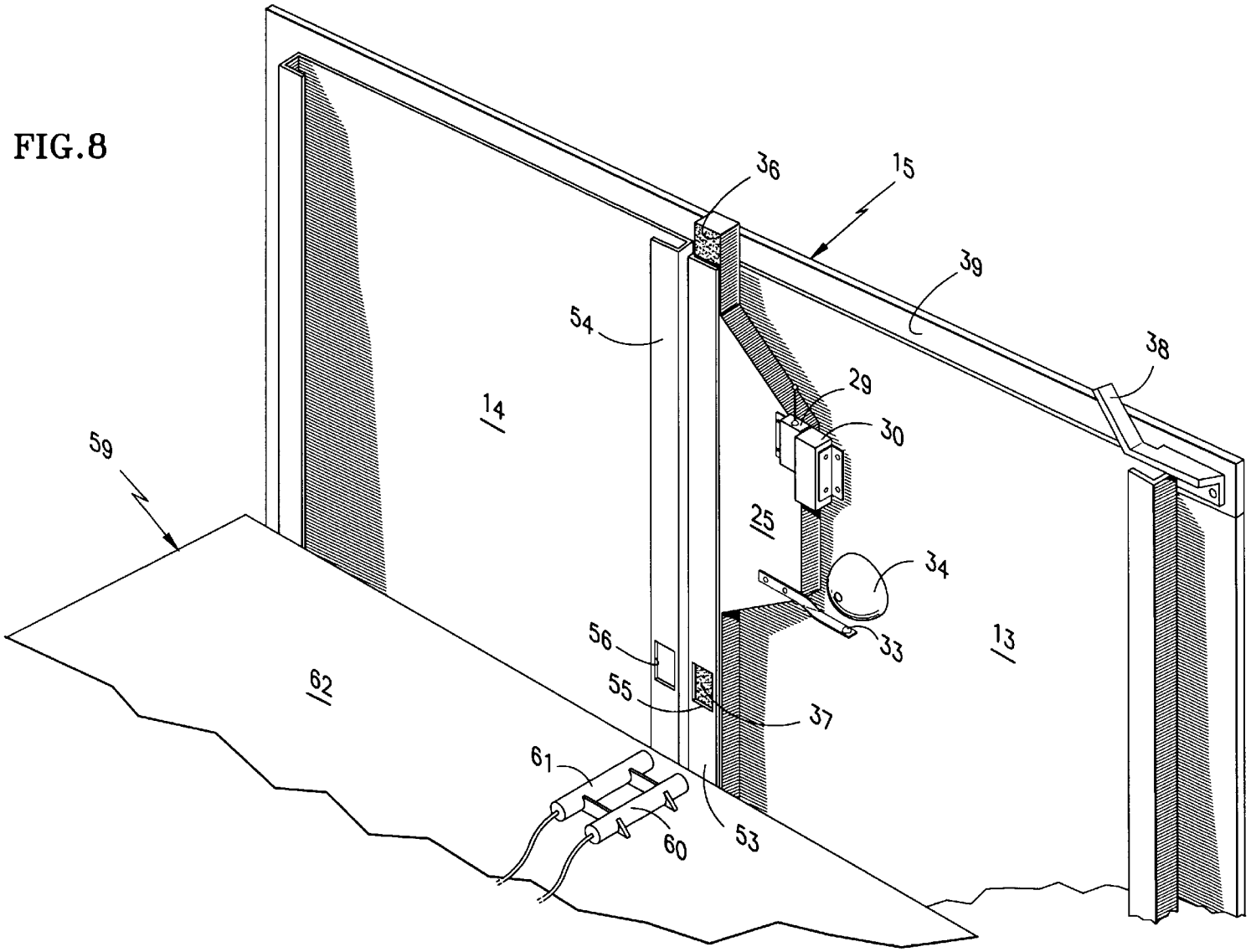
FIG. 8 is a simplified, stylistic perspective view of the rear of the hoistway doors of FIGS. 1 and 2, and the top of an elevator cab.

Referring to FIG. 8, the flags 36 and 37 become visible when the slider is in the upper position. Each of the doors 13, 14 have lips 53, 54 which extend inwardly from the door edge, such as the edge 47 (FIG. 5) of the door 13. Each of the edges 53, 54 has a hole 55, 56 through which the lower flag 37 (and similar flag for the door 14) become visible when the slider 25 is in the upper position as shown in FIG. 8. Similarly, the flag 36 appears above the lip 53 when the slider 25 is in the upward position. This renders the flags 36, 37 detectable from the elevator car 59. In FIG. 8, a pair of flag sensors 60, 61 are disposed on the canopy 62 of the elevator in a position to be able to sense the flags 36, 37 (and similar flags on the door 14 when properly positioned to represent a down call). As an example, the flags 36, 37 may simply be a colored area, quite distinct from anything else that is seen on the inside of the hoistway, and the detectors 60, 61 being retroreflective optical detectors utilizing appropriately colored filters. On the other hand, the flags 36, 37 may be highly reflective areas, the edges 53, 54 and any other appropriate surfaces within the hoistway being a dark, dull color. Then the sensors 60, 61 could simply be retroreflective optical sensors. The sensors 60, 61 may, for instance, be photoreflective detectors, having both an emitter and a detector therein, such as a Sharp T5589, with suitable filters if necessary.

When the doors 13, 14 are opened following registration of a call request, as the door 13, for instance, moves toward the right as seen in FIG. 8, the top of the slider 25 (near the upper edge of the flag 36) will engage the stationary reset arm 38, pushing the slider 25 downward, as a result of the rightward motion of the door 13 and therefore of the slider 25. Once the slider is in its fully downward position (FIGS. 3 and 4), the latch 43 will engage the lip 42 automatically, and hold the slider 25 in its full downward position.

Figure 9:
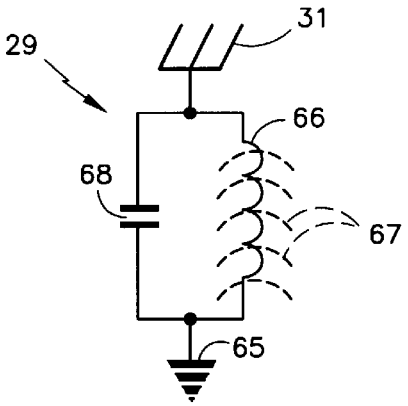
FIG. 9 is a schematic diagram of a passive transmitter for use in the invention.

Referring to FIG. 9, an exemplary form of the passive transmitter 29 may comprise a simple L/C tank circuit extending from ground 65 to the antenna 31. As the passive transmitter 29 moves upwardly adjacent to the stationary magnet 30, the coil 66 will pass through magnetic lines of flux 67 thereby generating current which will resonate between the capacitor 68 and the coil 66. This will cause the antenna 31 to emit a decaying, RF electromagnetic oscillation at a specific frequency determined by the R/C tank circuit time constant. The tank circuits for other floors and for other directions will each have their own unique frequency so that the call request floor and direction will be distinguishable.

Figure 10:
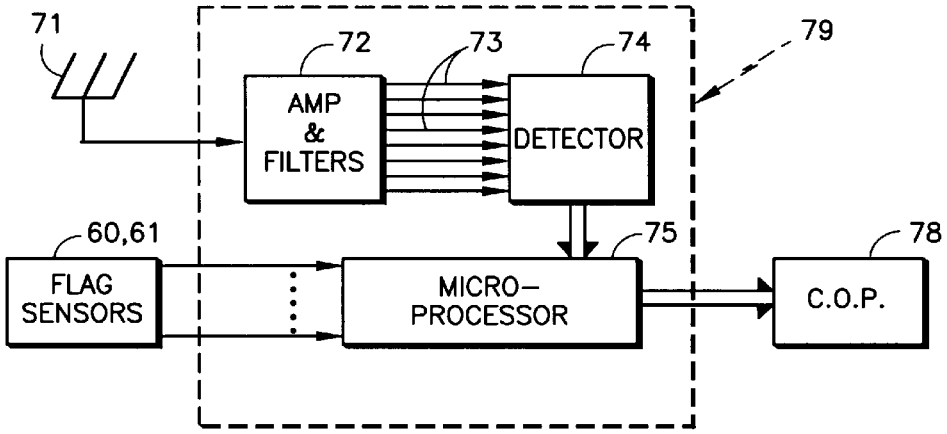
FIG. 10 is a schematic block diagram of car-mounted apparatus for sensing registered hall calls using radio frequency transmissions.

Signals emitted by the antenna 31, and other antennas for the down direction and for calls to other floors, will all be sensed by an antenna 71 which is disposed either on the car or at some point in the hoistway where it will be maximally responsive to all of the antennas on the various floors. Any signal received from the antenna 71 is applied to amplification and filter circuitry 72 so that the determination of the floor and direction can be made by providing a distinct signal on one of a plurality of lines 73 to a detector circuit 74. In FIG. 10, it is assumed that the elevator will serve four floors so there are eight different frequencies, eight filters and eight different signal lines 73 indicating the floor and direction of the call request. Signals from the detector circuit 74 may be fed to a microprocessor 75, which in turn can provide call requests directly to the car operating panel 78 (COP), which typically houses the car call buttons used to select destination floor stops. In fact, the hall call requests can be answered simply by forcing false car calls in the car operating panel 78. Thus, the system of the invention requires little additional apparatus on an elevator car in order to effectively handle hall calls. The apparatus 72–75 may be mounted within an equipment housing 79 which may be located on top of the car 59, or somewhere within the car. Alternatively, if the call signals are to be fed to a car controller (instead of the COP), which may be disposed in a machine room, the equipment housing 79 may be disposed near the car controller.

The flag sensors 60, 61, being mounted on the car, accommodate all the floors of the building. The car flags serve as a backup system to the RF transmitter system, to handle cases where the system may be uncertain as to the status of current hall calls. This may occur if the system is disrupted, following a reset, or following a power outage. For example, cars in a low rise simplex system are normally parked at the lowest floor; following a power interruption of any sort, the car may automatically make a low speed upward run, so that the sensors 60, 61 could determine whether any hall calls have been entered, or not. The lower flag is in a suitable position, the car stop control point, so that the car can stop at the floor where the lower flag is visible. The upper flag is located where it can be seen with the car parked at a floor with its doors closed; thus if a call is entered when the car is at that floor, the sensor 60 will detect the presence of the upper flag 36 and send the call request through the microprocessor 75 to the car operating panel 78. If desired, sensors similar to the sensors 60, 61 can be mounted on the underside of the elevator car so as to be able to stop the car in a downward direction in response to sensing the upper flag 36 or the lower flag 37.

Figure 11:
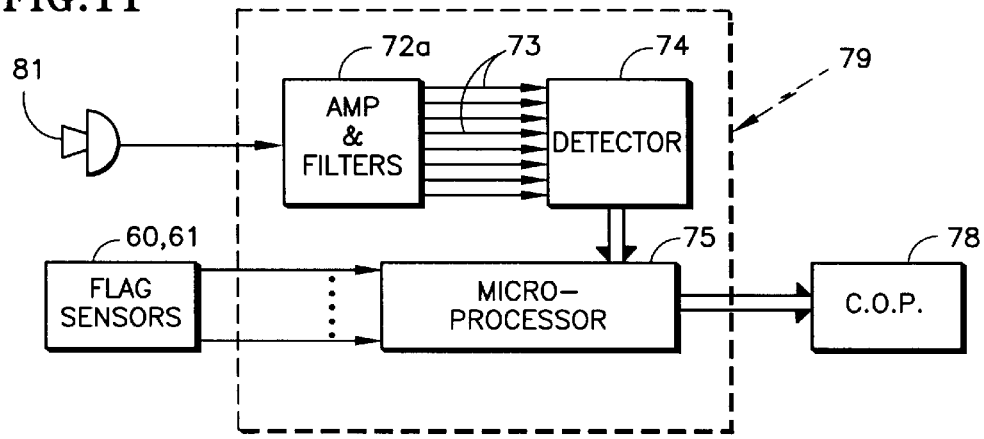
FIG. 11 is a schematic block diagram of alternative apparatus for sensing registered hall calls using acoustics.

An alternative form of the invention is illustrated in FIG. 11. Therein, instead of an antenna 71, a microphone 81 it utilized to a collect acoustic signals within the hoistway. In this embodiment, each of the bells 34 will have a sufficiently different tone so as to be A distinguished by means of filters within the amplifier and filter circuitry 72*a*. If desired, each bell 34 could be replaced with a pair of bells having tones with a fixed phase relationship, and a dual striker could be used so as to excite both bells in response to a hall call for the given floor and direction. These tones may then be sensed in a fashion similar to the dual tone multi-frequency processing (DTMF) utilized in touch tone telephones. Thus, whether the signal be electromagnetic or acoustic, it is a wireless signal that avoids any necessity to provide wiring in the building in order to respond to hall calls. The passive transmitters 29 and magnets 30 may be eliminated in this embodiment.

The foregoing description is of an example of the invention, which can, of course, be manifested in a large variety of ways. Although guides will be required for the slider 25, such guides have been omitted herein for the sake of clarity. It is contemplated that the slider 25 may be guided on three sides by the lip 53 (FIG. 8), and edge 47 (FIG. 5), but it need not necessarily be so. The sliders 25 may be formed of a suitable plastic, or they may be formed of metal. But since the sliders 25 provide blockage through the holes 23, 24 in the hoistway doors 13, 14, the sliders 25 must be formed of fire-resistant material. Call buttons 21, 22 are preferably disposed on the edge of the door as shown, but they may be disposed in other positions on the doors, if desired. The invention has been shown with respect to the left-hand door 13 and up direction chevron-like indications 23, 28; all of the apparatus for down calls that might be applied to the door 14 will be similar, and a mirror image of those on the door 13, and therefore the description thereof is deemed wholly unnecessary.

The invention has been described as it may be utilized with two call buttons at each floor, one for each direction. In a super-low cost elevator system, only a single call button need be utilized, in which case the arrow pattern in the call button 21 and in the chevron-like directional indication 23, 28 would be shaped in some other way. The present invention does not announce the approach of a car to a given floor, nor indicate the approaching car's direction. If desired, a car approach gong and directional indication lanterns could be disposed within the car itself to provide an audible approach signal, and once the hoistway doors 13, 14 are open, to indicate the direction in which the car is traveling. Thus, only one gong and one set of lanterns would serve the entire building, and would not require on-site installation in the building as do such fixtures installed in the elevator corridors.

The passive transmitter 31 could be mounted directly to the door 13, and the permanent magnet 30 could be mounted on the slider 25, if desired. The signal need not be radio frequency, it may, instead be electromagnetic radiation at any frequency which is suited to any particular implementation of the present invention.

The slider 25 is shown herein as sliding from a latched lower rest position to an unlatched, call-indicating upper position. Instead, the slider could be latched in an upward position and slide to a lower position. However, this would provide difficulty locating the stationary reset arm 38, since the lower end of the hoistway doors must be clear for passengers, whereas the upper end is available for apparatus, as shown. On the other hand, the slider may be disposed to slide horizontally. In a hoistway door, such as the door 13, that opens by sliding from right to left were to have a horizontal slider mounted on it which went from a rightward rest position to a leftward call indicating position, such a slider would easily be reset by a stop which the slider would engage as the door becomes fully open, thereby returning it to its rightward rest position relative to the hoistway door. Such a system could be beneficial in allowing the flags 36, 37 to slide from positions which are out of the field of view of the sensors 60, 61 to positions in which they are in the field of view. The slider 25 may also be replaced by a rotating member; thus, the invention may be practiced with a moveable member which either slides or rotates. Similarly, latching and unlatching might be simpler with the call button 21 hinged as shown in FIGS. 5 and 7 operating a horizontally rotatable latch 43. Similar other variations may be made to suit any particular utilization of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. Hall call registering apparatus for a simplex elevator system, comprising:

an elevator hoistway door;

a call button disposed in said elevator hoistway door;

a moveable element disposed on said hoistway door resiliently urged to move along a predetermined path;

a latch having a first position in which it engages said member when said member is at a first end of said path, to prevent it from moving along said path, said latch having a second position in which it is disengaged from said member so that said member moves along said path to a second end of said path in response to resilient urging, said latch assuming said second position in response to said call button being pressed;

indicator means having a first portion disposed on said hoistway door and a second portion disposed on said member and operative, in response to said member moving along said path to said second end of said path, to provide an indication to a prospective passenger that a hall call requested by pressing said call button has been registered; and signal means having a first portion disposed on said hoistway door and a second portion disposed on said member for providing a unique wireless signal indicating a hall call request for the floor corresponding to said hoistway door in response to said member moving along said path.

2. Apparatus according to claim 1 wherein said one portion of said indicator comprises a bell and another portion of said indicator comprises a bell clapper, thereby providing an audible indication that a hall call has been registered.

3. Apparatus according to claim 2 wherein said bell is disposed on said door and said clapper is disposed on said member.

4. Apparatus according to claim 2 wherein said signal means comprises said bell and clapper, whereby said signal comprises an acoustic wave.

5. Apparatus according to claim 1 wherein one portion of said indicator comprises at least one hole in said hoistway door and the other portion of said indicator comprises at least one unique indicium which is seen through said at least one hole when said member is in said second position, thereby providing a visual indication that a hall call has been registered.

6. Apparatus according to claim 1 wherein one portion of said signal means comprises a permanent magnet and another portion of said signal means comprises a passive tuned circuit feeding an antenna, whereby said signal is electromagnetic radiation.

7. Apparatus according to claim 6 wherein said permanent magnet is disposed on said door and said tuned circuit and antenna are disposed on said member.

8. Apparatus according to claim 1 wherein one portion of said signal means comprises a bell and the other portion of said signal means comprises a bell clapper, whereby said signal comprises an acoustic wave.

9. Apparatus according to claim 1 wherein said hoistway door is slidable between open and closed positions; and further comprising:

a stationary reset arm, said reset arm, in response to said hoistway door being moved into the fully open position, pushing on said member, thereby causing said member to re-traverse said predetermined path and become locked in said first position by said latch.

10. Apparatus according to claim 9 wherein said door is slidable within a frame and said reset arm is mounted on said frame.

11. Apparatus according to claim 1 wherein said member further comprises at least one indicia which is senseable from within the hoistway when said member is in said second position, and is otherwise not senseable; and means disposed on said elevator car for sensing said indicia when said member is at said second end of said path, thereby providing a signal indicative of the registration of a hall call at the floor adjacent the present position of the elevator car.

12. Apparatus according to claim 1 wherein said member slides along said path.

13. Apparatus according to claim 1 wherein said path is a straight line.

14. Apparatus according to claim 13 wherein said predetermined path is vertical.

15. Apparatus according to claim 13 wherein said first end of said path is below said second end of said path.

* * * * *